US011282665B2

(12) United States Patent
Oh et al.

(10) Patent No.: US 11,282,665 B2
(45) Date of Patent: Mar. 22, 2022

(54) ARC EXTINGUISHING UNIT OF MOLDED CASE CIRCUIT BREAKER

(71) Applicant: LS Electric Co., LTD., Anyang-si (KR)

(72) Inventors: Kihwan Oh, Anyang-si (KR); Kyunghwan Oh, Anyang-si (KR); Younghwan Kim, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 17/060,923

(22) Filed: Oct. 1, 2020

(65) Prior Publication Data

US 2021/0020397 A1 Jan. 21, 2021

Related U.S. Application Data

(62) Division of application No. 16/657,324, filed on Oct. 18, 2019, now Pat. No. 10,840,047.

(30) Foreign Application Priority Data

Mar. 29, 2019 (KR) ..... 10-2019-0037220
Mar. 29, 2019 (KR) ..... 10-2019-0037222

(51) Int. Cl.
*H01H 73/18* (2006.01)
*H01H 33/08* (2006.01)
(Continued)

(52) U.S. Cl.
CPC ..... *H01H 73/18* (2013.01); *H01H 9/362* (2013.01); *H01H 33/08* (2013.01); *H01H 71/10* (2013.01); *H01H 2009/365* (2013.01)

(58) Field of Classification Search
CPC ..... H01H 73/18; H01H 9/362; H01H 33/08; H01H 71/10; H01H 2009/365; H01H 9/32; H01H 9/34; H01H 73/04
See application file for complete search history.

(56) References Cited

U.S. PATENT DOCUMENTS 3,632,926 A * 1/1972 Heft ..... H01H 9/346 218/90
10,128,069 B1 * 11/2018 Ruempler ..... H01H 9/36
(Continued)

FOREIGN PATENT DOCUMENTS

EP 2784795 A1 10/2014
JP 2014038751 A 2/2014
KR 101594870 B1 2/2016

OTHER PUBLICATIONS

Korean Office Action for related Korean Application No. 10-2019-0037220; dated Apr. 21, 2020; (4 pages).
(Continued)

*Primary Examiner* — Truc T Nguyen
(74) *Attorney, Agent, or Firm* — K&L Gates LLP

(57) ABSTRACT

The present disclosure relates to an arc extinguishing unit of a molded case circuit breaker with a barrier provided between a fixed contact and a movable contact when a circuit is cut off, including fixed contacts fixed to part of a base assembly case; movable contacts that come contact or are separated from the fixed contacts; and an arc extinguishing part that extinguishes an arc generated when the movable contacts are separated from the fixed contacts. The arc extinguishing part includes a pair of side plates; multiple grids installed at a fixed interval between the pair of side plates; and arc barriers each installed on a base assembly case in a slidable manner, and configured to be in an open state of being separated from the movable contacts when a normal current flows on the circuit or is cutoff, and to close when a fault current is cutoff.

12 Claims, 11 Drawing Sheets

(51) Int. Cl.
*H01H 71/10* (2006.01)
*H01H 9/36* (2006.01)

(56) References Cited

U.S. PATENT DOCUMENTS

| | | | | |
|---|---|---|---|---|
| 10,957,504 | B1 * | 3/2021 | Shea | H01H 33/53 |
| 2006/0086693 | A1 * | 4/2006 | Yeon | H01H 9/342 218/149 |
| 2014/0131317 | A1 * | 5/2014 | Malingowski | H01H 73/18 218/148 |
| 2015/0348720 | A1 * | 12/2015 | Smeltzer | H01H 9/36 218/151 |
| 2020/0312599 | A1 * | 10/2020 | Oh | H01H 33/08 |

OTHER PUBLICATIONS

Korean Office Action for related Korean Application No. 10-2019-0037222; dated Apr. 21, 2020; (4 pages).

* cited by examiner

ARC EXTINGUISHING UNIT OF MOLDED CASE CIRCUIT BREAKER

CROSS-REFERENCE TO RELATED APPLICATION

This application is a U.S. Divisional application based on U.S. application Ser. No. 16/657,324 filed on Oct. 18, 2019 which claims the benefit of earlier filing date and right of priority to Korean Application No. 10-2019-0037220, filed on Mar. 29, 2019, and Korean Application No. 10-2019-0037222, filed on Mar. 29, 2019, the contents of which are incorporated by reference herein in its entirety.

FIELD

The present disclosure relates to an arc extinguishing unit of a molded case circuit breaker, and particularly, to an arc extinguishing unit of a molded case circuit breaker with a barrier provided between a fixed contact and a movable contact when a circuit is cut off.

BACKGROUND

In general, a molded case circuit breaker (MCCB) is an electric instrument that is installed in part of an electric system to protect the circuit and load by automatically cutting off the circuit in an electrical overload state or a short circuit fault.

The molded case circuit breaker generally includes a terminal part that may be connected to a power side or load side, a contact part including a fixed contact and a movable contact that may come in contact with or be separable from the fixed contact to connect or separate the circuit, a switching mechanism that moves the movable contact to supply power required to open/close the circuit, a trip part that detects an over-current or a short circuit current that flows on the circuit to induce a trip motion of the switching mechanism, and an extinguishing part that extinguishes an arc occurred in breaking an abnormal current.

FIG. 1 shows an internal structure of the conventional molded case circuit breaker. The conventional molded case circuit breaker includes a case 9 formed of an insulating material, a fixed contact 1 and a movable contact 2 which are provided within the case 9 to form a contact part that connects or cuts off a circuit connected from the power to the load, a switching mechanism 4 that provides a power to rotate the movable contact 2, an extinguishing part 3 that extinguishes an arc generated when cutting off a fault current, and a trip part 5 that detects an abnormal current and trips the switching mechanism 4, and the like. Here, reference numeral 8 denotes a base assembly case.

When an accident current flows on the circuit, a trip operation is conducted to disconnect the movable contact 2 from the fixed contact 1 to cut off the current flow, an arc is produced at the contact points of the contacts 1 and 2. At this time, the arc size (the intensity) is proportional to the magnitude of the current. The arc is a gas in the atmosphere that is momentarily plasma-conditioned by voltage, with an arc center temperature ranging from 8,000 to 12,000° C. and explosive inflation pressure. As a result, the continuation of the arc will have a significant impact on the performance and durability of the breaker, as the arc melts and dissipates the contacts 1 and 2, and deteriorates and destroys the surrounding components. Therefore, the arc has to be rapidly cut off, sealed and discharged within the extinguishing part 3.

As such, the work of treating arc in the event of an accident current in a molded case circuit breaker becomes the main goal in protecting the product, load and track by blocking the accident current and directly affecting the performance of the breaker.

FIGS. 2 and 3 show a base assembly of the conventional molded case circuit breaker. FIG. 2 shows a current flow state, and FIG. 3 shows a cut-off state. FIG. 4 is a perspective view of the extinguishing part.

The base assembly includes a base assembly case (or, briefly base) that is formed of an insulating material by an injection molding and contact parts 1 and 2 and the extinguishing part 3 that are installed in the base assembly case 8.

The movable contact 2 is engaged to a shaft assembly 6 which rotates by receiving the force of the switching mechanism 4 and the contact points that the contact point of the movable contact 2 and the contact point of the movable contact 2 are in contact with each other are disposed inside a side plate 3*a* of the extinguishing part 3.

The operation of the base assembly during accident current cut-off is as follows.

In the event of an accident current, the switching mechanism 4 is actuated by the action of the trip part 5 and the shaft assembly 6 rotates clockwise. At this time, an arc occurs at the contacts 1 and 2 and the arc is extended by moving to a grid 3*b* inside an arc chamber 3. The arc moves along the grid 3, causing the arc voltage to rise and cool down, eventually resulting in the arc dissipation.

Due to the high temperature arc generated during the cut-off, part of the metal parts of the contacts 1 and 2 and the shaft 6 are melted and dispersed into metal grains. These metal particles remain inside the base assembly case 8. In other words, it becomes a pollutant.

In the conventional art, arc extinguishing function was improved mainly by adjusting the rotational speed of the shaft assembly 6 and the shape of the grid. However, there is a limit to these improvements.

In addition, metal particles generated by heat generated during arc extinction will contaminate the inside of the base assembly. When the metal grains are trapped in the drive unit of the shaft assembly 6 or the contact points of the contacts 1 and 2, the breaking performance may be deteriorated.

SUMMARY

Therefore, an aspect of the detailed description is to provide an arc extinguishing unit of a molded case circuit breaker that provides an arc barrier between movable contacts and fixed contacts to effectively cut off an arc.

According to an embodiment of the present disclosure, an arc extinguishing unit of a molded case circuit breaker includes: fixed contacts fixed to part of a base assembly case; movable contacts that come in contact with or are separated from the fixed contacts; and an arc extinguishing part that extinguishes an arc generated when the movable contacts are separated from the fixed contacts, and the arc extinguishing part includes: a pair of side plates disposed at both sides of the movable contacts and the fixed contacts; multiple grids installed at a fixed interval between the pair of side plates; and arc barriers each penetratingly-installed on a base assembly case in a slidable manner, and configured to be in an open state of being separated from the movable contacts when a normal current flows on the circuit or is cutoff, and to close between the movable contacts and the fixed contacts by being magnetized by the magnetic field generated by an arc between the movable contacts and the fixed contacts when a fault current is cutoff.

Here, both sides of the base assembly case include barrier receptors, respectively, formed inwardly projected to be adjacent to the arc extinguishing part.

In addition, the barrier receptor includes at an outer surface thereof a receiving groove.

In addition, the receiving groove includes at the center thereof a sliding hole in which the arc barrier may be moved in a sliding manner.

In addition, a stopper is formed in a stepped manner at part of the receiving groove that restricts the movement of the arc barrier.

In addition, a barrier actuation groove is formed on an inner surface of the receptor in which part of the arc barrier may be inserted In addition, the grid disposed on the upper part of the multiple grids includes a body part and a leg part, and the grid disposed on the lower part includes a body part.

In addition, the side plates include an insertion part in which the leg part is inserted, and the lower part of the insertion part is incised to provide a barrier actuation part where the arc barrier operates.

In addition, the arc barrier includes a magnetic member movably installed in the receiving groove; a sliding member that is fitted to the magnetic member and installed to be inserted in the barrier actuation groove; an elastic member that is fitted in the receiving groove to provide an elastic force to move the magnetic member outward.

In addition, the magnetic member is configured to move the sliding member inwardly by the attraction generated by being magnetized by magnetic field that becomes larger than the elastic force of the elastic member, upon cutoff of a fault current.

In addition, the magnetic member includes a coupling hole, and the sliding member includes a shield plate part installed to move in a direction orthogonal to the movement direction of the movable contacts; and a connection part installed to be moved in the sliding hole in a sliding manner and configured to connect the shield plate part and the magnetic member.

In addition, the shield plate part of the arc barrier that is fitted on one side of the base assembly case includes an insertion plate formed in a protruding manner, and the shield plate part of the arc barrier that is fitted on the other side of the base assembly case includes an insertion hole in which the insertion plate is inserted.

In the arc extinguishing unit of a molded case circuit breaker according to an embodiment of the present disclosure, the arc barrier is installed between the movable and fixed contacts at the time of the cut-off and thus the arc cut-off operation is performed efficiently.

The arc barrier is provided at a side wall or base assembly case of the arc extinguishing part and operates rapidly at the time of the cut-off.

The arc barrier is operated by interlocking with the movable contacts or a magnetic field that occurs when cut off, so there is no failure of operation.

The arc barrier is formed by a pair of left and right asymmetric shapes, and is partially overlapped with each other, which has a great breaking effect.

BRIEF DESCRIPTION OF THE DRAWINGS

FIGS. 2 and 3 are internal perspective views illustrating the molded case circuit breaker of FIG. 1, in which FIG. 2 shows a current flow state and FIG. 2 shows a cut-off state;

FIGS. 11 through 14 are views illustrating the cut-off processes of the arc extinguishing unit of the molded case circuit breaker in accordance with an embodiment of the present disclosure, in which FIGS. 11 and 12 show a current flow state and a cut-off state when a normal current flows on the circuit, and FIGS. 13 and 14 show a current flow state and a cut-off state when a fault current flows on the circuit, respectively.

DETAILED DESCRIPTION

Hereinafter, preferred embodiments of the present disclosure will be described with reference to the accompanying drawings, so that a person skilled in the art can easily carry out the disclosure. It should be understood that the technical idea and scope of the present disclosure are not limited to those preferred embodiments.

Referring to the accompanying drawings, description will be given in detail of an arc extinguishing unit of a molded case circuit breaker in accordance with each embodiment of the present disclosure.

Figure 4:
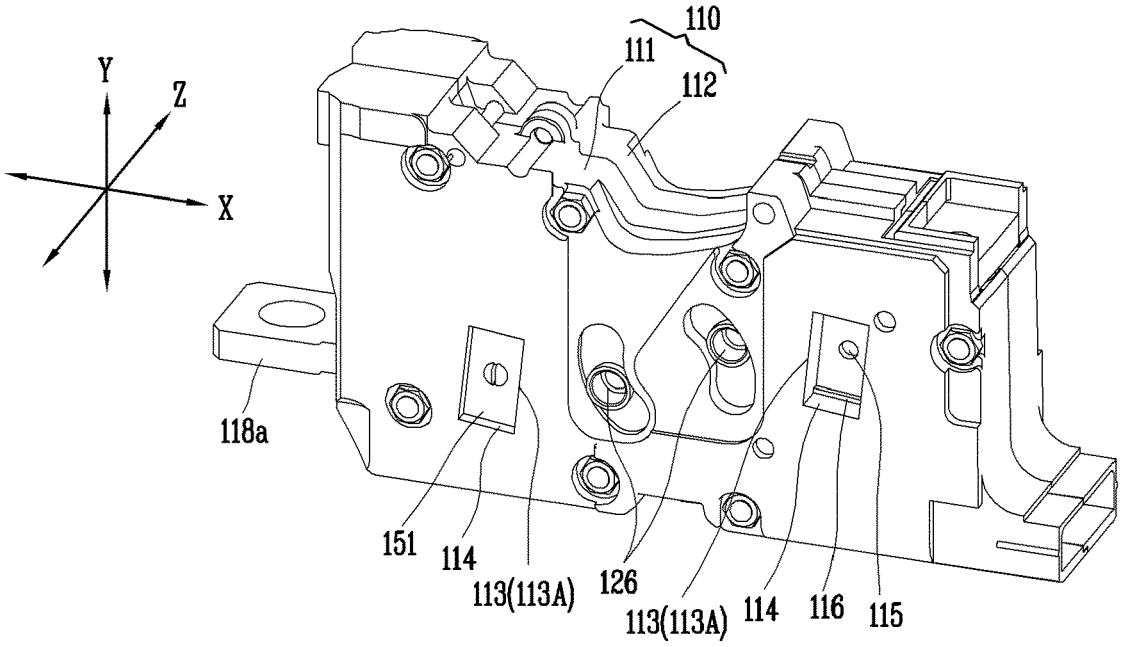
FIG. 4 is a perspective view illustrating a base assembly applied to a molded case circuit breaker in accordance with another embodiment of the present disclosure.
Figure 5:
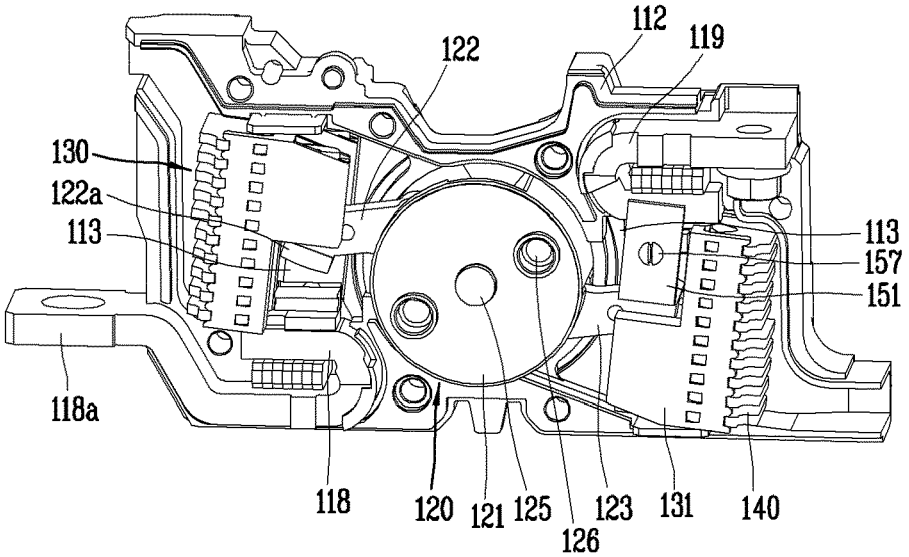
FIG. 5 is a perspective view illustrating an internal structure of the base assembly of FIG. 4, in which an arc barrier of a left contact part is omitted.
Figure 6:
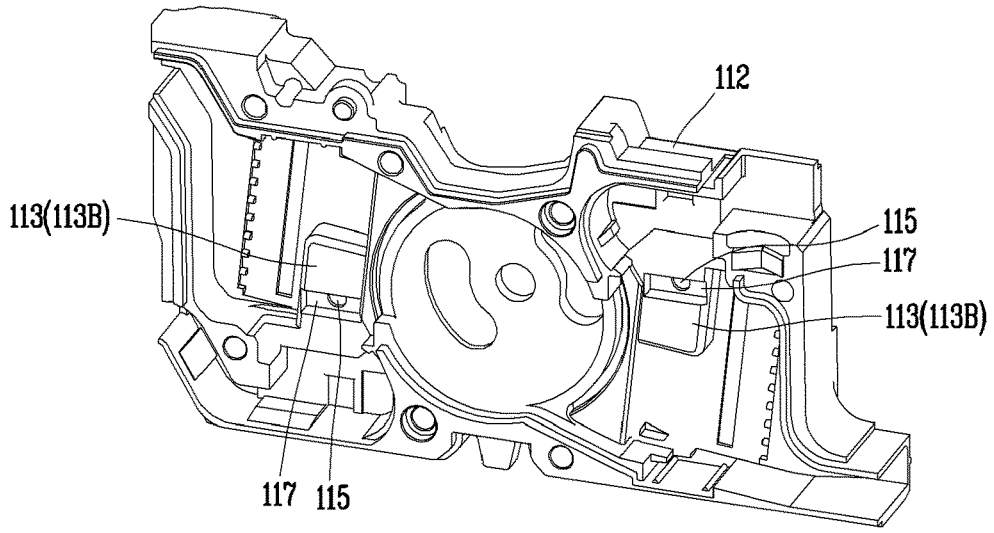
FIG. 6 is a perspective view of a second base mold of FIG. 5.

FIG. 4 is a perspective view illustrating a base assembly applied to a molded case circuit breaker in accordance with one embodiment of the present disclosure, FIG. 5 is a perspective view illustrating an internal structure of the base assembly of FIG. 4, in which an arc barrier of a left contact is omitted, and FIG. 6 is a perspective view of a second base mold of FIG. 5.

The arc extinguishing unit of the molded case circuit breaker in accordance with another embodiment of the present disclosure includes fixed contacts 118 and 119 fixed to part of a base assembly case 110; movable contacts 122 and 123 that come in contact with or are separated from the fixed contacts 118 and 119; and an arc extinguishing part 130 that extinguishes an arc generated when the movable contacts 122 and 123 are separated from the fixed contacts 118 and 119, and the arc extinguishing part 130 includes a pair of side plates 131 disposed at both sides of the movable contacts 122 and 123 and the fixed contacts 118 and 119; multiple grids 140 installed between the pair of the side plates 131 at a predetermined interval; and arc barriers 150 and 160 each penetratingly-installed on the base assembly case 110 in a sliding manner, and configured to be in an open state by being separated from the movable contacts 122 and 123 when a normal current flows or is cutoff, and to close between the movable contacts 122 and 123 and the fixed contacts 118 and 119 by being magnetized by the magnetic field generated by an arc between the movable contacts 122 and 123 and the fixed contacts 118 and 119 when a fault current is cut off.

Figure 1:
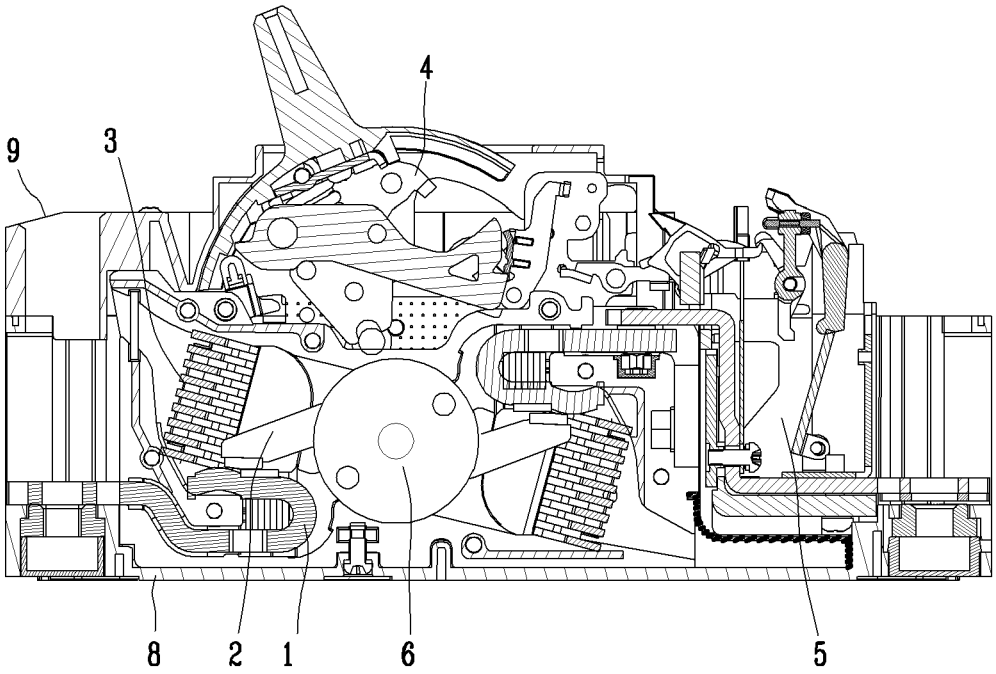
FIG. 1 PRIOR ART
FIG. 1 is a view illustrating an internal structure of a conventional molded case circuit breaker.
Figure 2:
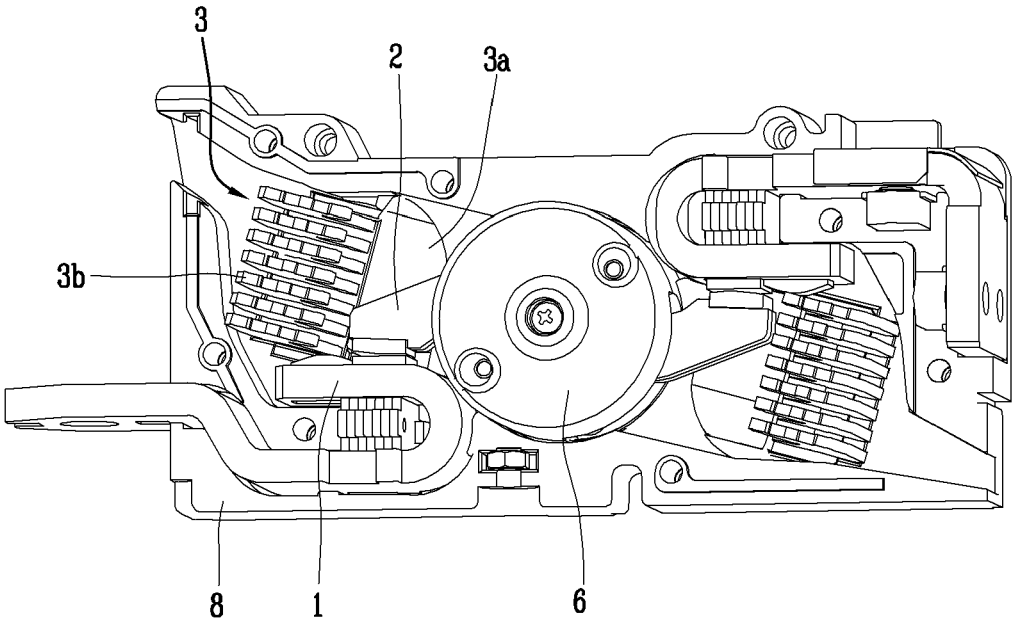
FIG. 2 PRIOR ART
Figure 3:
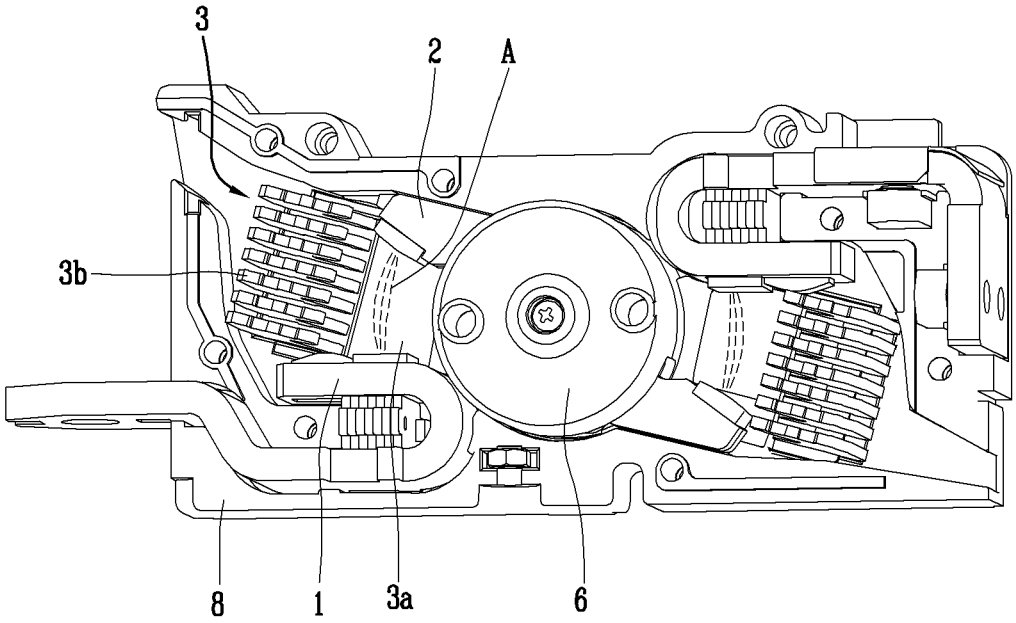
FIG. 3 PRIOR ART

The arc extinguishing unit in accordance with one embodiment of the present disclosure may be applied to a general molded case circuit breakers. Accordingly, general matters on the molded circuit breakers may refer to the conventional techniques (for instance, see FIG. 1).

The base assembly case 110 (briefly referred to as a base) is prepared. The base assembly case 110 may be formed by an injection molding. The base assembly case 110 is formed approximately in the form of a box. It is recommended that the base assembly case 110 is formed from an insulating material. Inside the base assembly case 110, contact points 18,119,122, and 123 and an arc extinguishing part 130 are installed. A switching mechanism (not shown) may be installed at the top of the base assembly case 110.

The base assembly case 110 may consist of two corresponding injection moldings. This may be divided into a first base mold 111 and a second base mold 112. The first base mold 111 may refer to FIG. 4 and the second base mold 112 may refer to FIGS. 5 and 6. The first base mold 111 and the second base mold 112 may be symmetrical in most of the features.

The base assembly case 110 includes a barrier receptor 113. The barrier receptor 113 is formed in the first base mold 111 and the second base mold 112, respectively. This is referred to as a first barrier receptor 113A and a second barrier receptor 113B, for classification purposes. The shape of the first barrier receptor 113A and the second barrier receptor 113B may be the same.

The barrier receptor 113 is formed adjacent to the area where the side plates 131 of the arc extinguishing part 130 are disposed. In other words, from the side, the barrier receptor 113 is formed to overlap the side plates 131 of the arc extinguishing part 130.

The barrier receptor 113 is formed in the form of a box that protrudes into the inner side of each base mold 111, 112. Here, the barrier receptor 113 is provided with a receiving recess 114, which is formed by grooves on the outer face of each base mold 111, 112.

The receiving recess 114 has a sliding hole 115 which allows the arc barriers 150 and 160 to be installed in the center for sliding. The sliding hole 115 allows the inside and outside of the base assembly case 110 to be communicated. (To show the sliding hole, the arc barrier is removed from the receiving recess on the right side of FIG. 4.)

A stopper 116 is provided on the first side of the receiving recess 114. The stopper 116 may be constructed into a stepwise form or protruding on the surface of the receiving recess 114. The stopper 116 may limit the movement range of the arc barriers 150 and 160.

The inner surface of the barrier receptor 113 (inside of the base molds 111 and 112) may include a barrier actuation groove 117. The barrier actuation groove 117 may receive or withdraw part of the arc barriers 150 and 160. The sliding hole 115 may be formed on part of the barrier actuation groove 117.

Contacts 118,119,122, and 123 are prepared inside the base assembly case 110. The contacts 118,119,122, and 123 include fixed contacts 118 and 119 and movable contacts 122 and 123.

The fixed contacts 118 and 119 are prepared. The fixed contacts 118 and 119 include a fixed contact 118 on the power side and a fixed contact 119 on the load side. The power-side fixed contact 118 may be formed integrally with a power-side terminal 118*a*. The load-side fixed contact 119 may be connected to the load-side terminal (not shown) through the trip apparatus (not shown). The fixed contacts 118 and 119 are provided with fixed contact points 118*a* and 119*a*, respectively.

The shaft assembly 120 is prepared. The shaft assembly 120 is fitted with a pair of rotary pins (not shown). The shaft assembly 120 rotates by receiving the opening and closing power of the switching mechanism (not shown) via the rotary pins. As the shaft assembly 120 rotates, the movable contacts 122 and 123 rotate to contact or disengage from the fixed contacts 118 and 119.

The shaft assembly 120 includes a shaft body 121 and the movable contacts 122 and 123.

The shaft body 121 is formed in the form of a cylindrical shape. The rotary shaft 125 protrudes on the flat side surfaces of the shaft body 121 (first circular plane). The shaft body 121 is provided with a pair of rotary pin holes 126 which are parallel to the direction of the rotary shaft 125 and allow for the insertion of the rotary pin.

The movable contacts 122 and 123 are rotatably installed on the shaft body 121 along the circumference. The movable contacts 122 and 123 contact or disconnect with the fixed contacts 128 and 119 with the shaft body 121, or independently rotating in a counterclockwise or clockwise direction, to allow a current to flow in the circuit or cut off the circuit.

Both ends of the movable contacts 122 and 123 are provided with movable contact points 122*a* and 123*a* that may be contacted by the fixed contact points 118*a* and 119*a* of the fixed contacts 118 and 119, respectively. The movable contact points 122*a* and 123*a* may be made from materials with good conductivity and durability, such as chromium-copper (Cr—Cu) alloys.

The movable contacts 122 and 123 rotate with the shaft body 121, in a normal small current or large current cut-off situations, but in case of transition interruption, the movable contacts 122 and 123 rotate independently due to the rapid electromagnetic repulsive force. In this case, the movable contacts 122 and 123 contact the shaft pin (not shown) fitted to the opening formed on the circumference of the shaft body 121, causing the rotation to stop.

The arc extinguishing part 130 is prepared around the fixed contact points 118*a* and 119*a* of the fixed contacts 118 and 119 and the movable contact points 122*a* and 123*a* of the movable contacts 122 and 123 in order to extinguish the arc generated during current cutoff.

Figure 7:
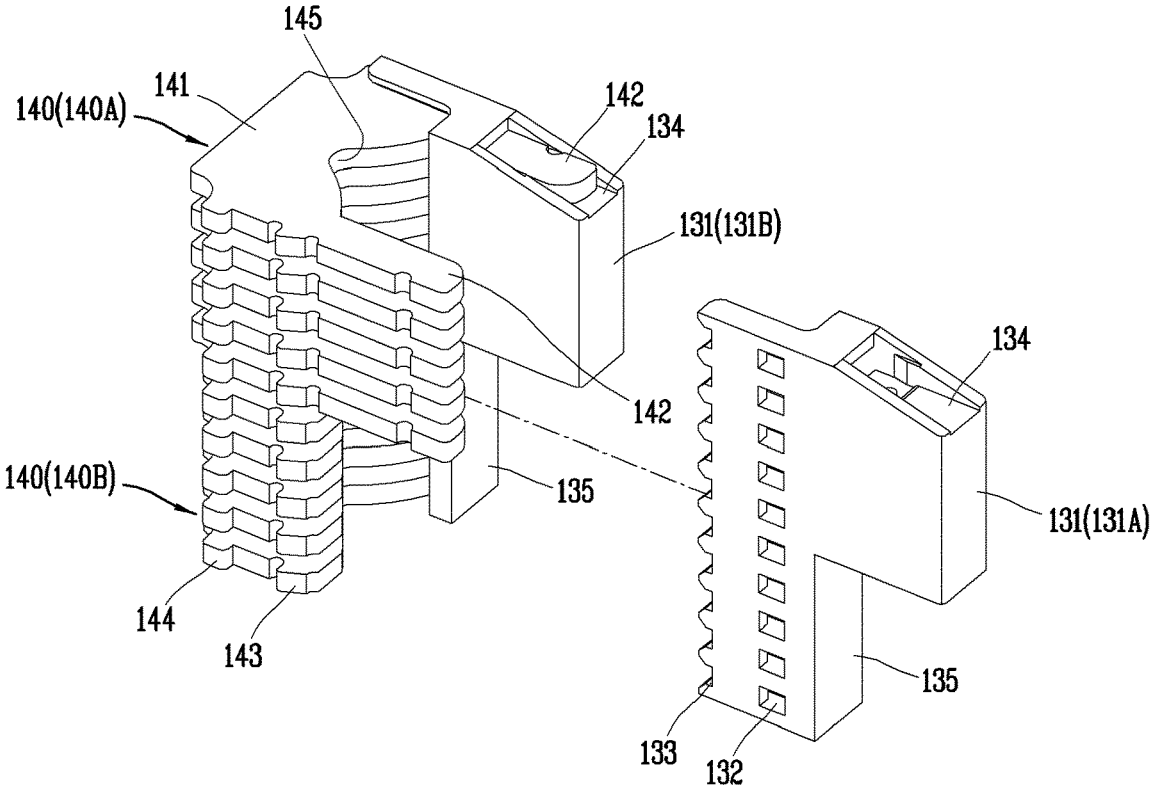
FIG. 7 is a perspective view illustrating an arc chamber applied to a molded case circuit breaker in accordance with another embodiment of the present disclosure.

FIG. 5 shows the installation state of the arc extinguishing part, and FIG. 7 is a perspective view of the arc extinguishing part, in which a first side plate is separated.

The arc extinguishing part 130 is prepared to extinguish the arc produced during the current cut-off. The arc extinguishing part 130 is also referred to as the arc extinguishing unit or arc chamber.

The arc extinguishing part 130 (arc chamber) includes a pair of side plates 131 symmetrically disposed and a grid 140 consisting of multiple steel plates and inserted side by side between the side plates 131 at a specified interval. The arc extinguishing part 130 has an interior space where the arc may be extinguished, surrounded by the side plates 131 and the grid 140.

When the circuit is in a normal state, that is, a current flows on the circuit, the fixed contact points 118*a* and 119*a* of the fixed contacts 118 and 119 and the movable contact points 122*a* and 123*a* of the movable contacts 122 and 123 are connected, causing the current to flow. When an accident current is generated at the circuit, the switching mechanism is actuated by the action of the trip part (not shown) which causes the movable contacts 122 and 123 to rotate, disconnecting the movable contact points 122*a* and 123*a* from the fixed contact points 118*a* and 119*a* and disconnecting the current. At this time, an arc is produced between the movable contact points 122*a* and 123*a* and the fixed contact points 128*a* and 119*a*. This arc is enhanced by absorption into the grid 140, divided into short arcs as it enters between the grid 140, and eventually the arc voltage rises and is dissipated.

The side plates 131 are prepared in a symmetrical pair. It is recommended that the side plates 131 are formed of an insulating material. In other words, the arc produced during the cut-off may be reflected from the side plates 131 and collected into the grid 140.

When the pair of side plates 131 are referred to separately, they may be divided into two side plates, i.e., a first side plate 131A and a second side plate 131B. In other words, the first side plate 131A is to be appended with a subscript A and the second side plate 131B is to be appended with a subscript B. When distinction is also required for the attachment of the first and second side plates 131A and 131B, hereinafter, the subscripts, A and B will be added.

The rear part of the side plate 131 has multiple fit holes 132 and fit grooves 133 where the grid 140 may be combined. In addition, on the front part of the side plate 131, an insertion part 134 is provided for the insertion of the leg part of the grid 140.

A grid 140 is prepared to absorb, divide and cool the arc. At this time, multiple grids 140 are arranged and installed at fixed intervals on the pair of side plates 131.

The grid 140 is formed by a flat plate. The grid 140 is made of steel to facilitate the absorption of arcs. The grid 140 may include a body part 141 and a leg part 142.

Multiple insertion protrusions 143 and 144 are formed on both sides of the body part 141 of the grid 140 to be installed on the side plates 131. The insertion protrusions 143 and 144 of the grid 140 are inserted into the fit hole 132 and the fit groove 133 of the side plate 131. At this time, caulking may be performed for stable coupling.

The body part 141 of the grid 140 is partially cut out between the leg part 142 to form a guide part 145. The guide part 145 is prepared to provide a space for the absorption of the arc generated at the time of cutting-off (interrupting) the contact parts. The guide part 145 may be formed with a V-shaped groove and a U-shaped groove. Accordingly, the arc extinguishing part 130 can improve the extension performance of the arc.

The grid 140 may be prepared in multiple numbers and installed at the fixed interval on the side plates 131 with multiple layers. As a result, a passageway between the grid 140 may be provided for the arc to pass through. The spacing when the grid 140 is stacked may be set properly, taking into account the division and absorption force of the arc.

The upper grid 140A includes the body part 141 and the leg part 142, and the lower grid 140B may include only the body part 141B. That is, the grid 140B placed on the underside may be configured with the leg part 142 removed.

The lower part of the insertion part 134 at the front of the side plate 131 is provided with a barrier actuation part 135 which may be installed with the arc barriers 150 and 160. The barrier actuation part 135 may be prepared by incision of part (bottom) of the front of the side plate 131. In other respects, part (bottom) of the side plate 131 is formed with no insertion part 134 in place or with the insertion part 134 removed.

At this point, the grid 140A with the leg part 142 is placed on the upper part of the side plate 134, i.e., the part where the insertion part 134 is prepared, and the grid 140B without the leg part 142 is placed on the lower part of the side plate 131, i.e., the part where the barrier actuation part 135 is prepared.

Figure 8:
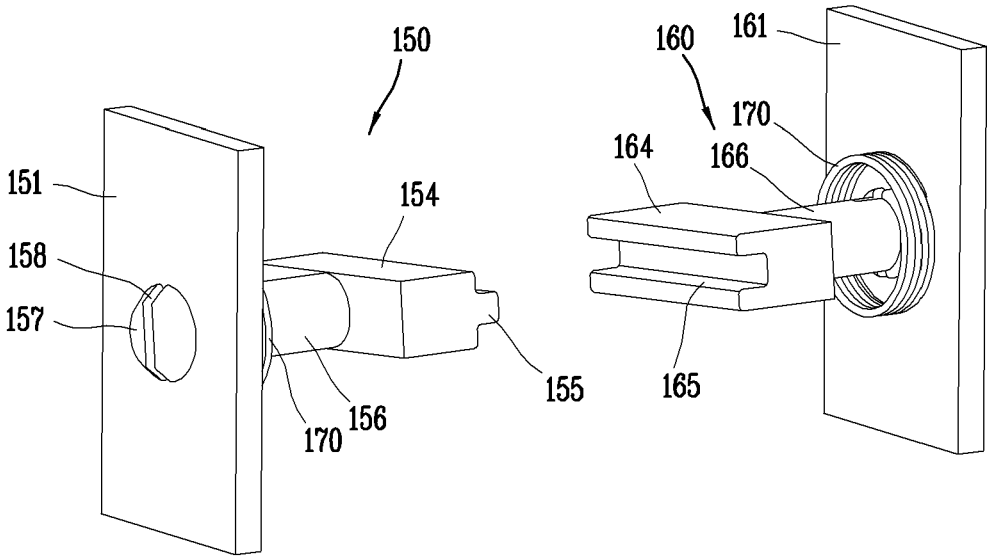
FIGS. 8 and 9 are a perspective view and a separated perspective view of an arc barrier applied to a molded case circuit breaker in accordance with another embodiment of the present disclosure.
Figure 9:
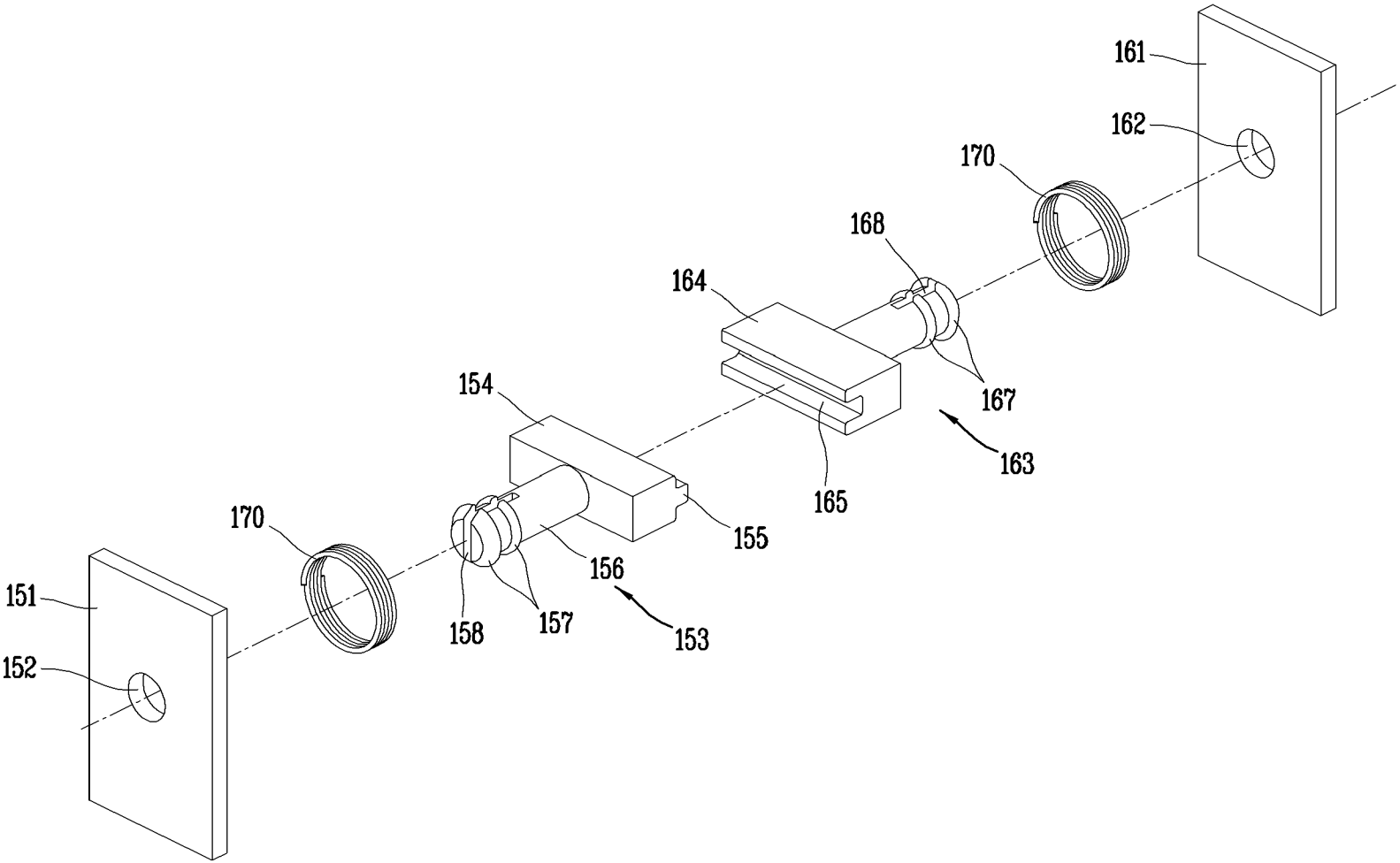
Figure 10:
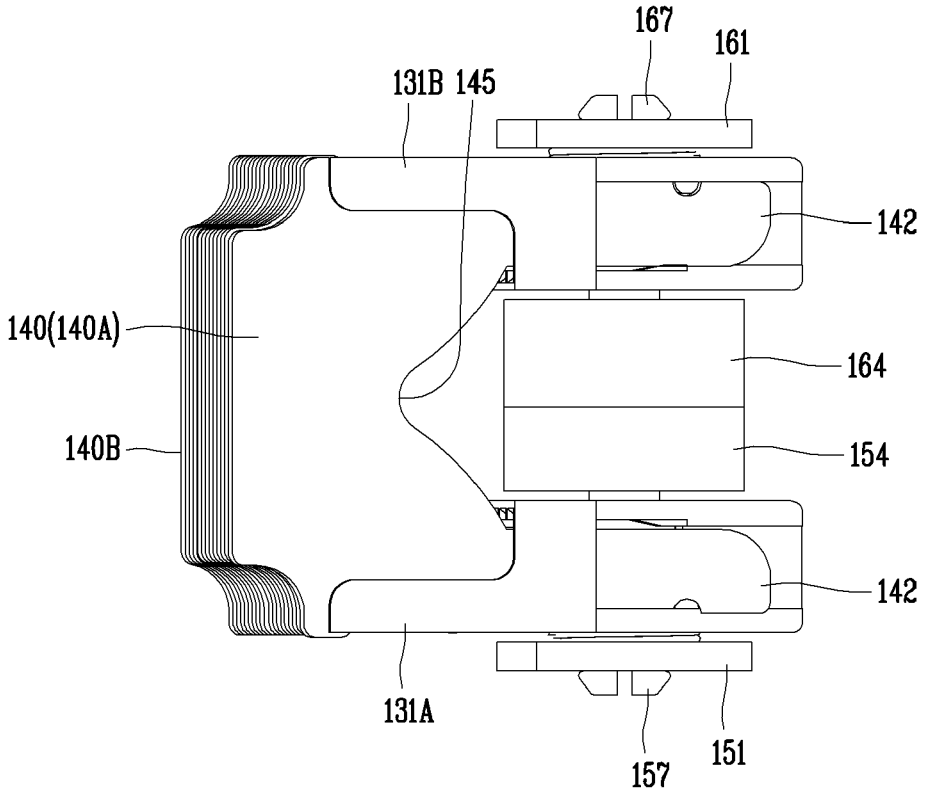
FIG. 10 is a top view of the arc chamber and the arc barrier.

Referring further to FIGS. 8 through 10, in which FIGS. 8 and 9 are a perspective view and a separated perspective view of the arc barrier applied to the molded case circuit breaker in accordance with one embodiment of the present disclosure, and FIG. 10 is a top view of the arc chamber and the arc barrier.

The arc barriers 150 and 160 are prepared. The arc barriers 150 and 160 remain open under normal current-flow conditions, allowing contact and separation between the fixed contacts 118 and 119 and the movable contacts 122 and 123 to occur without interference, while in the fault current situation, the arc barriers 150 and 160 are positioned between the fixed contacts 118 and 119 and the movable contacts 122 and 123 to be considerably shut down, blocking the arc generated at the contact parts. It is desirable for the arc barriers 150 and 160 to be formed from insulating materials.

The arc barriers 150 and 160 may include magnetic members 151 and 161, sliding members 153 and 163, and an elastic member 170.

The magnetic members 151 and 161 may be formed by a flat plate. The magnetic members 151 and 161 are then placed parallel to the side surface of the base assembly case 110. The magnetic members 151 and 161 include at least a parallel part on the side of the base assembly case 110. The magnetic members 151 and 161 are formed to have a certain area and magnetized by the arc that occurs during the cut-off. The magnetic members 151 and 161 are formed from materials such as magnet or iron that can be magnetized by magnetic fields.

The magnetic members 151 and 161 are inserted and installed in the receiving groove 114 of the base molds 111 and 112. At this time, the cross section of the magnetic members 151 and 161 may be formed in the same shape (e.g. rectangles) as the shape of the receiving groove 114. The thickness of the magnetic members 151 and 161 may be less than the depth of the receiving groove 114. Accordingly, the magnetic members 151 and 161 may move forward and backward within the receiving groove 114. This means that the magnetic members 151 and 161 are capable of linear motion along the z-direction (in the direction of the rotary shaft of the shaft assembly) in FIG. 4.

Coupling holes 152 and 162 are formed in the central part of the magnetic members 151 and 161.

The sliding members 153 and 163 include connection parts 156 and 166 and shield plate parts 154 and 164. It is desirable that the sliding members 153 and 163 are formed from insulating materials.

The connection parts 156 and 166 are joined by inserting into the coupling holes 152 and 162 of the magnetic members 151 and 161. For coupling force, the rear end of the connection parts 156 and 166 may be formed with annular fixing projections 157. In addition, a straight slit 158 may be formed along the longitudinal axis at the rear of the connection parts 156 and 166 to improve assembly.

The shield plate parts 154 and 164 are prepared for arc blocking. The shield plate parts 154 and 164 may be formed to have the length (width) acceptable between the pair of side plates 131. In other words, the length (width) of the shield plate parts 154 and 164 in the cut-off state are formed less than the spacing between the pair of side plates 131.

The shield plate parts 154 and 164 may be formed with a square plate. The shield plate parts 154 and 164 may be formed by a flat plate. The shield plate parts 154 and 164 may be positioned in a direction orthogonal to the magnetic members 151 and 161 (on the xz plane in FIG. 4).

The shield plate parts 154 and 164 are the part that blocks the arc. In the event of a fault current (first accident current) cut-off, the shield plate parts 154 and 164 are placed between the fixed contact points 118*a* and 119*a* and the movable contact points 122*a* and 123*a* to cut off the arc between the contact area early (pushing to the first guide part). When cutting off, the shield plate parts 154 and 164 are placed in a position that is approximately perpendicular to the direction of motion (up and down) of the movable contacts 122 and 123.

The arc barriers 150 and 160 are divided into a first arc barrier 150 fitted to a first base mold 111 and a second arc barrier 160 fitted to the second base mold 112.

The first arc barrier 150 and the second arc barrier 160 may have the same overall configurations. That is, the first arc barrier 150 and the second arc barrier 160 may include magnetic members 151 and 161, connection parts 156 and 166, and shield plate parts 154 and 164, respectively.

Here, the magnetic member 151 of the first arc barrier 150 and the magnetic member 161 of the second arc barrier 160 may be formed in the same shape as each other. The magnetic member 151 of the first arc barrier 150 and the magnetic member 161 of the second arc barrier 160 may be formed by the same members In addition, the connection part 156 of the first arc barrier 150 and the connection part 166 of the second arc barrier 160 may be formed equally.

However, the shield plate part 154 of the first arc barrier 150 and the shield plate part 164 of the second arc barrier 160 have similar overall shapes, but the detailed shapes are different.

The shield plate part 154 of the first arc barrier 155 is formed with an insertion plate 155 protruding in the front, and the shield plate part 164 of the second arc barrier 160 is formed with an insertion groove 165 protruding in the front. In the event of a fault current cut-off operation, the insertion plate 155 is fitted into the insertion groove 165 to completely cut off the arc. As a result, the arc blocking effect is increased.

Of course, this example is just for explanation purposes and the opposite type of example is possible. For example, it may be possible that the first arc barrier 150 is fitted to the second base mold 112 and the second arc barrier 160 is fitted to the second base mold 112.

An elastic member 170 is prepared to provide an elastic force that moves the arc barriers 150 and 160 to their original position (first arc barrier is in the open position). The elastic member 170 may consist of coil springs. The elastic member 170 is installed in the receiving groove 114. The elastic member 170 provides an elastic force in the direction of pushing the magnetic members 151 and 161 outward within the receiving groove 114.

Figure 11:
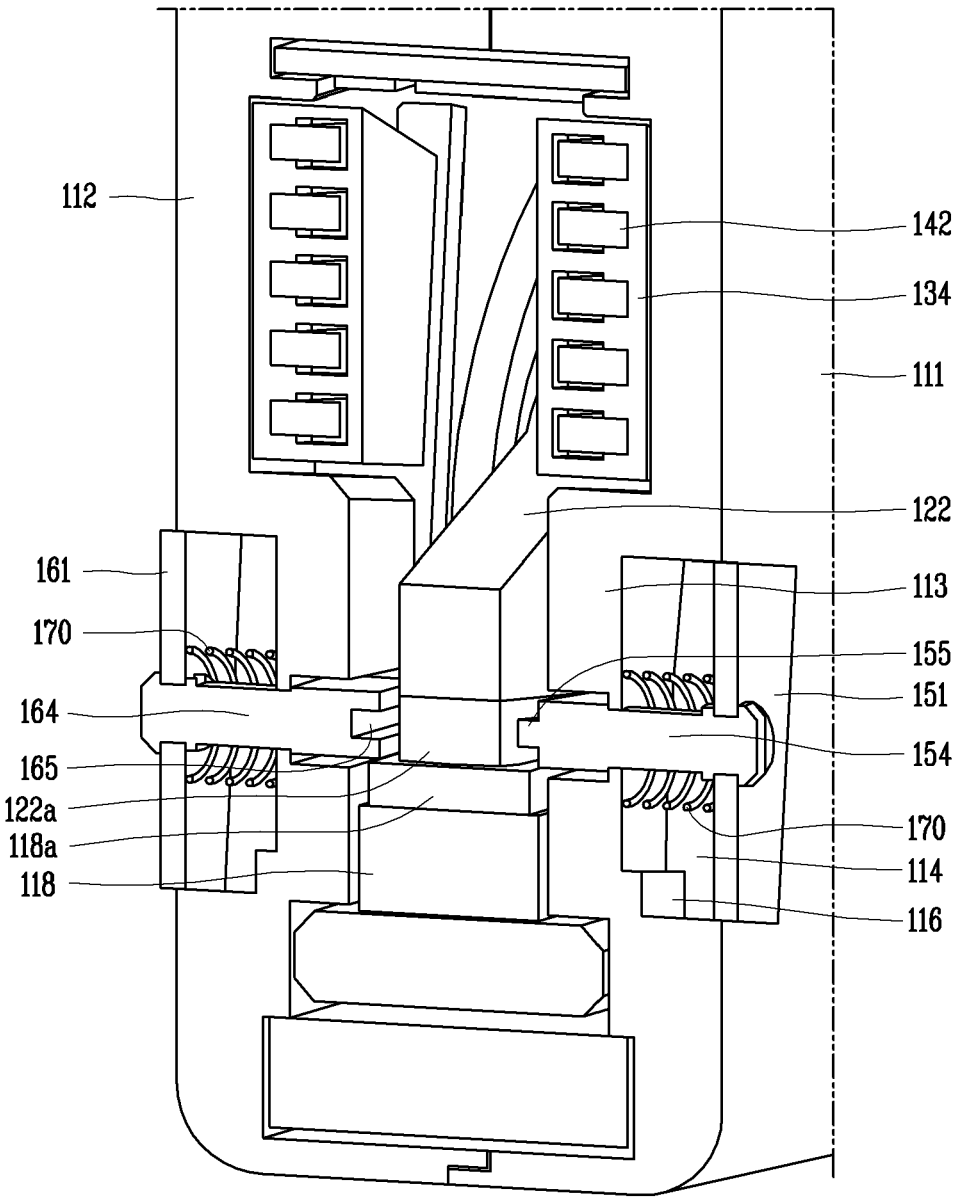
Figure 12:
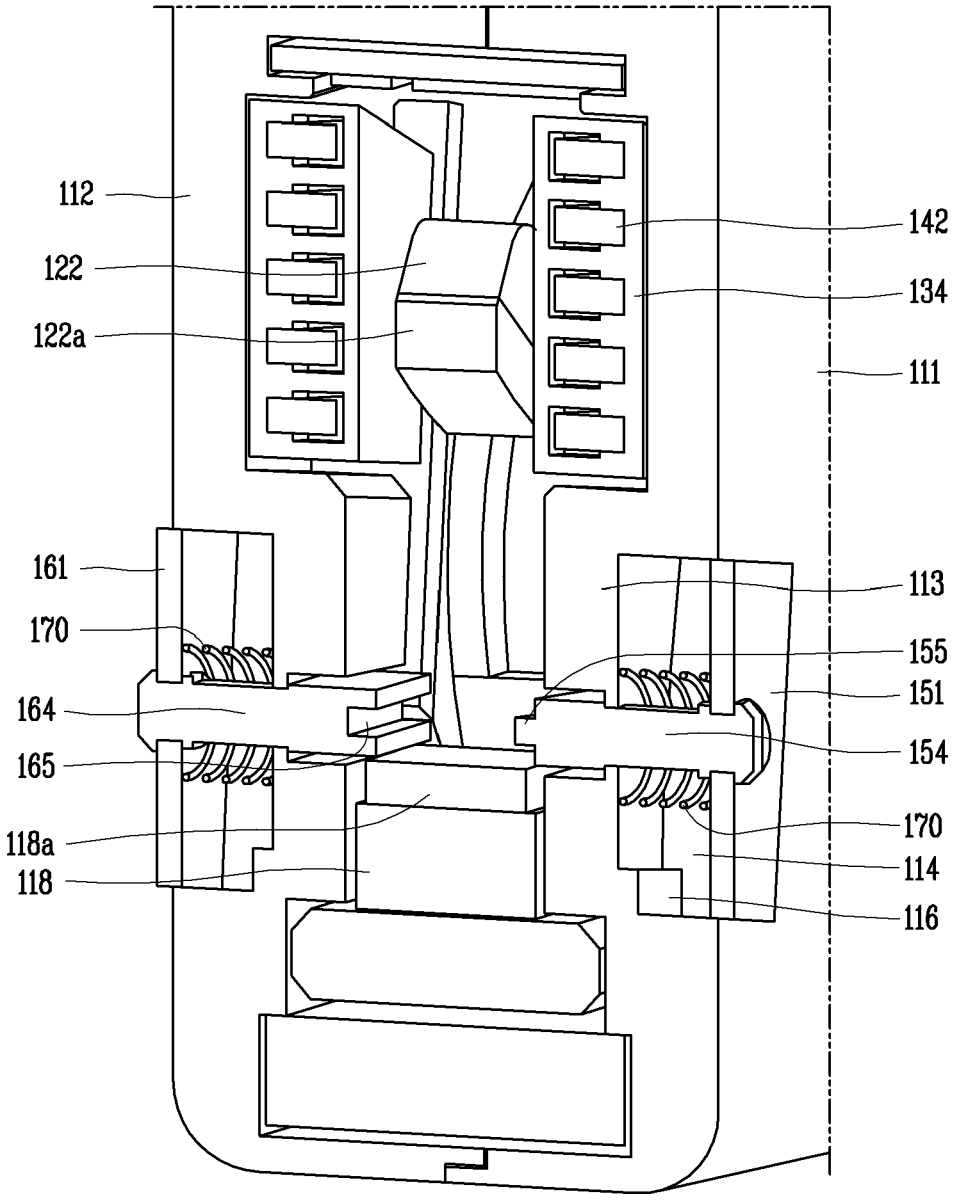
Figure 13:
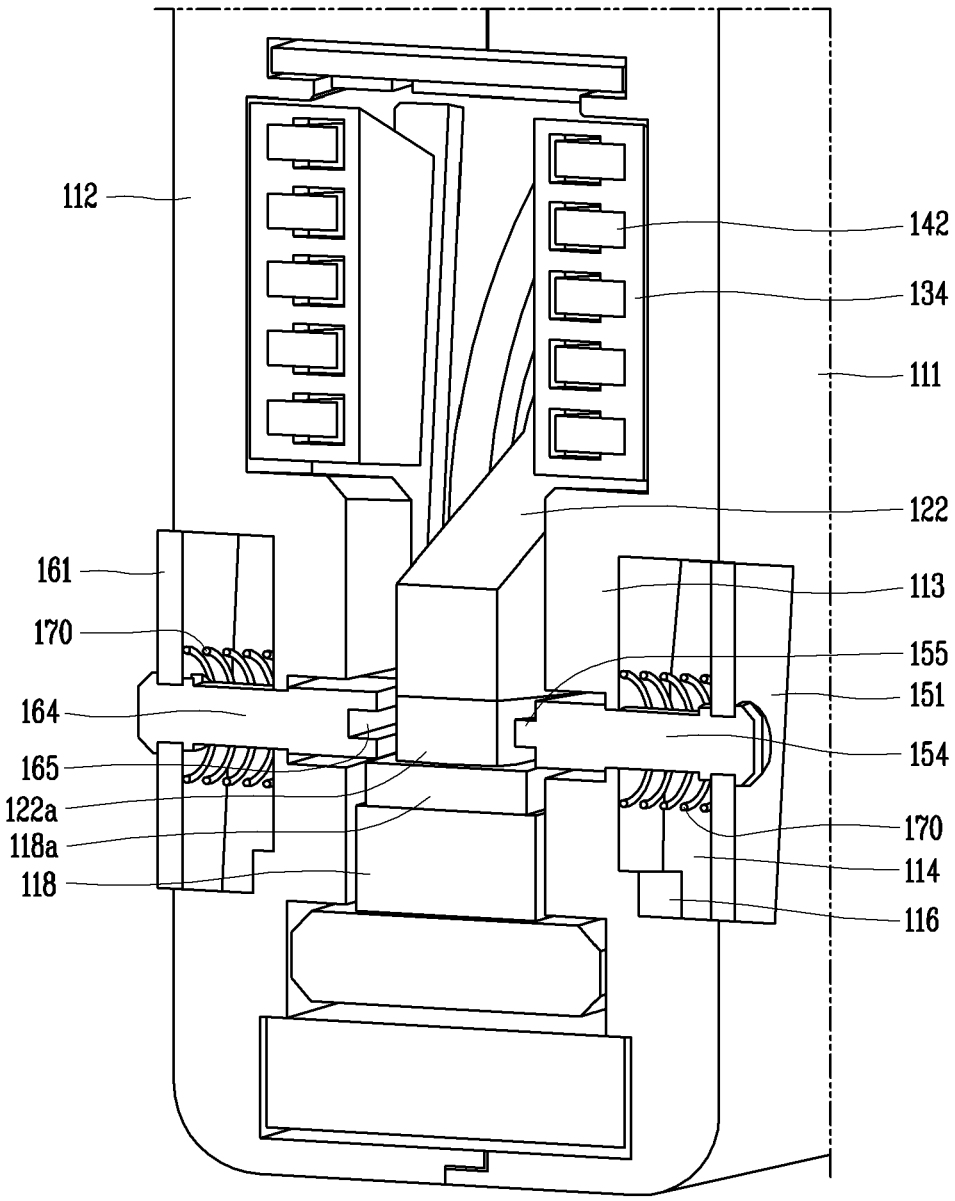
Figure 14:
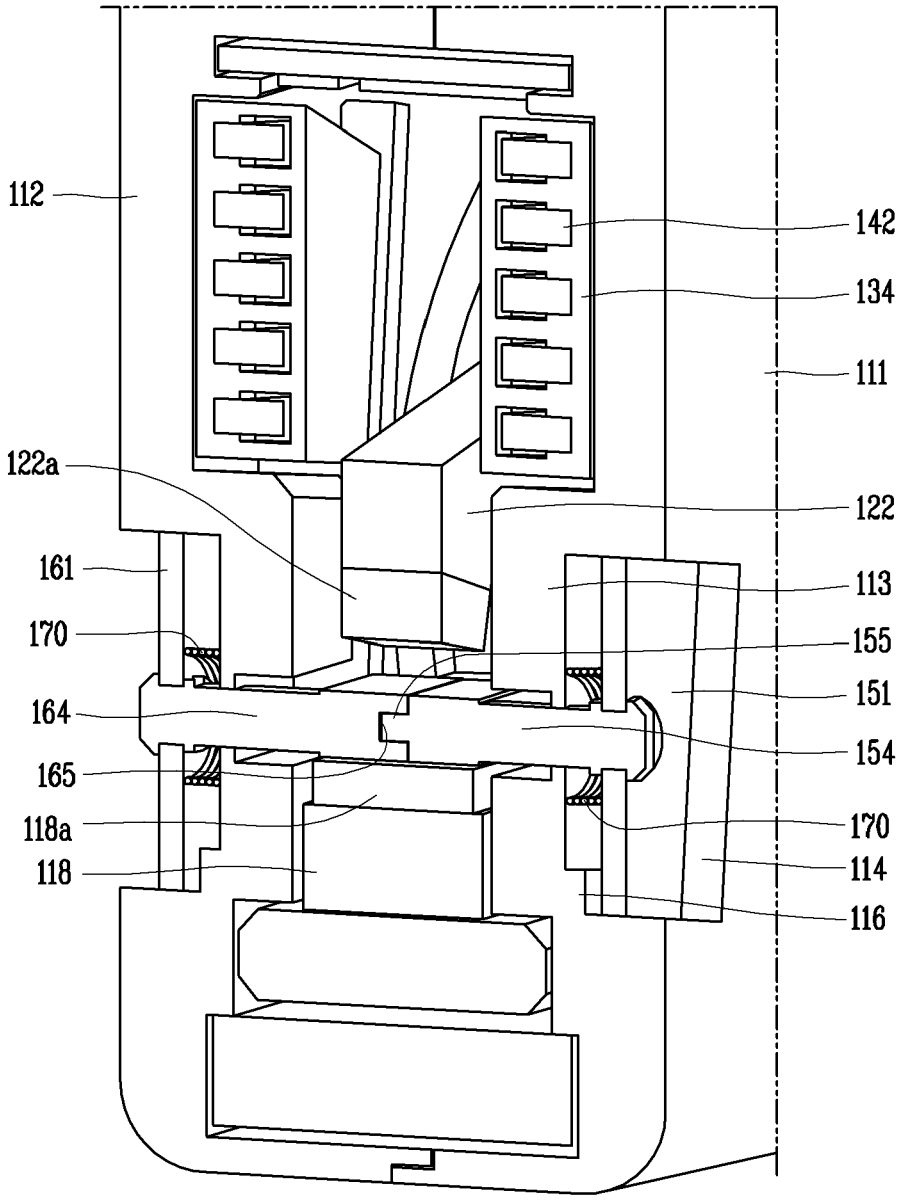

Description will be given of the operation of the arc extinguishing unit of the molded case circuit breaker in accordance with the detailed description with reference to FIGS. 11 through 14. FIGS. 11 and 12 show a current flow state and a cut-off state when a normal current flows on the circuit, and FIGS. 13 and 14 show a current flow state and a cut-off state when a fault current flows on the circuit, respectively.

First, the On or Off operation will be described when a normal current flows on the circuit.

In the normal state where a current flows on the circuit as shown in FIG. 11, the first arc barrier 150 and the second arc barrier 160 are in the open state by the elastic force of the elastic member 170. This means that the shield plate parts 154 and 164 are fully inserted into the barrier actuation groove 117. The magnetic members 151 and 161 are located in the outermost position. At this time, the first arc barrier 150 and the second arc barrier 160 remain as far apart from each other as possible. At this time, the first and second arc barriers 150 and 160 are separated from the movable contacts 122 and 123 so that they do not interfere with the movement of the movable contacts 122 and 123.

When the breaker is converted into an off state by the user's operation, the movable contacts 122 and 123 rotate upward and separate from the fixed contacts 118 and 119, as shown in FIG. 12, causing the circuit to break. As shown in FIG. 12, the cut-off action in normal current-flow conditions does not move the first arc barrier 150 and the second arc barrier 160. The first arc barrier 150 and the second arc barrier 160 are kept in the same position as when the current flows and are in the open state.

In summary, when on/off operation of a normal current, the arc barriers 150 and 160 are present in a position that remains open and do not interfere with the motion of the movable contacts 122 and 123.

Next, description will be given of the current flow and cut-off operations when the fault current (accident current) flows on the circuit.

In the current flow state as in FIG. 13, the first arc barrier 150 and the second arc barrier 160 are in the open state by the elastic force of the elastic member 170. This means that the shield plate parts 154 and 164 are fully inserted into the barrier actuation groove 117. The magnetic members 151 and 161 are located in the outermost position. At this time, the first arc barrier 150 and the second arc barrier 160 remain as far apart from each other as possible. At this time, the first and second arcing barriers 150 and 160 are separated from the movable contacts 122 and 123 so that they do not interfere with the movement of the movable contacts 122 and 123.

When a fault current flows through the circuit and a cut-off action is performed (by the trip part), as shown in FIG. 14, the movable contacts 122 and 123 rotate upward and separate each from the fixed contacts 118 and 119, causing the circuit to break. At this time, an arc occurs between the movable contacts 122 and 123 and the fixed contacts 118 and 119, creating a magnetic field that occurs around this arc, and by this magnetic field, magnetic members 151 and 161 are subjected to the force moving in a direction that magnetizes and absorbs each other. When the suction force is greater than elastic force of the elastic member 170, the resistance of the elastic member 170 will be overcome and the arc barriers 150 and 160 will move inward to each other.

Therefore, the first arc barrier 150 and the second arc barrier 160 are placed between the movable contacts 122 and 123 and the fixed contacts 118 and 119 and the arc occurring between the movable contacts 122 and 123 and the fixed contacts 118 and 119 is blocked. Referring to FIG. 11, this arc is extended as it moves to the guide part 145 and is divided and cooled down by the grid 140 to dissipate.

Here, the insertion plate 155 of the first arc barrier 150 is inserted into the insertion groove 165 of the second arc barrier 160 and is in an overlapped state. In other words, the part, viewed from the top, where the movable and fixed contact points 122*a* and 123*a* are located between the two side plates 131*a* and 119*a* is completely closed.

In summary, in the event of a fault current cut-off operation, the arc barriers 150 and 160 close between the movable contacts 122 and 123 and the fixed contacts 118 and 119 to cut off the arc.

While the disclosure has been shown and described with reference to the foregoing preferred embodiments thereof, it will be understood by those skilled in the art that various changes and modifications may be made without departing from the spirit and scope of the disclosure as defined by the appended claims. Therefore, the embodiments disclosed in the present disclosure are not intended to limit the scope of the present disclosure but are merely illustrative, and it should be understood that the scope of the technical idea of the present disclosure is not limited by those embodiments. That is, the scope of protection of the present disclosure should be construed according to the appended claims, and all technical ideas within the scope of equivalents thereof should be construed as being included in the scope of the present disclosure.

What is claimed is:

1. An arc extinguishing unit of a molded case circuit breaker, comprising:

fixed contacts fixed to part of a base assembly case;

movable contacts that come in contact with or are separated from the fixed contacts; and an arc extinguishing part configured to extinguish an arc generated when the movable contacts are separated from the fixed contacts, wherein the arc extinguishing part includes:

a pair of side plates disposed at both sides of the movable contacts and the fixed contacts;

multiple grids installed at a fixed interval between the pair of side plates; and arc barriers each penetratingly-installed on the base assembly case in a slidable manner, and configured to be in an open state of being separated from the movable contacts when a normal current flows on a circuit or is cutoff, and to close between the movable contacts and the fixed contacts by being magnetized by a magnetic field generated by an arc between the movable contacts and the fixed contacts when a fault current is cut off.

2. The arc extinguishing unit of claim 1, wherein both sides of the base assembly case include barrier receptors, respectively, formed inwardly and projected to be adjacent to the arc extinguishing part.

3. The arc extinguishing unit of claim 2, wherein a barrier receptor includes at an outer surface thereof a receiving groove.

4. The arc extinguishing unit of claim 3, wherein the receiving groove includes at a center thereof a sliding hole in which an arc barrier is moved in a sliding manner.

5. The arc extinguishing unit of claim 4, wherein a stopper is formed in a stepwise shape at part of the receiving groove that restricts the movement of the arc barrier.

6. The arc extinguishing unit of claim 4, wherein a barrier actuation groove is formed on an inner surface of the barrier receptor in which part of the arc barrier is inserted.

7. The arc extinguishing unit of claim 1, wherein an upper grid disposed on an upper part includes a body part and a leg part, and a lower grid disposed on a lower part includes a body part, among the multiple grids.

8. The arc extinguishing unit of claim 7, wherein the side plates include an insertion part in which the leg part is inserted, and wherein the lower part of the insertion part is incised to provide a barrier actuation part where an arc barrier operates.

9. The arc extinguishing unit of claim 6, wherein the arc barrier includes:

a magnetic member movably installed in the receiving groove;

a sliding member fitted to the magnetic member and installed to be inserted in the barrier actuation groove; and an elastic member provided in the receiving groove configured to provide an elastic force to move the magnetic member outward.

10. The arc extinguishing unit of claim 9, wherein the magnetic member is configured to move the sliding member inwardly by attraction generated by being magnetized by the magnetic field that becomes larger than the elastic force of the elastic member, upon cutoff of the fault current.

11. The arc extinguishing unit of claim 10, wherein the magnetic member includes a coupling hole, and wherein the sliding member includes:

a shield plate part installed to move in a direction orthogonal to a movement direction of the movable contacts; and a connection part installed to be moved in the sliding hole in a sliding manner and configured to connect the shield plate part and the magnetic member.

12. The arc extinguishing unit of claim 11, wherein the shield plate part of the arc barrier that is fitted on one side of the base assembly case includes an insertion plate formed in a protruding manner, and the shield plate part of the arc barrier that is fitted on another side of the base assembly case includes an insertion hole in which the insertion plate is inserted.

* * * * *